US005193473A

United States Patent [19]

Asao et al.

[11] Patent Number: 5,193,473

[45] Date of Patent: Mar. 16, 1993

[54] NEEDLE RECEIVING AND TRANSFERRING APPARATUS FOR SEWING MACHINE

[75] Inventors: Hideo Asao; Masato Takahashi, both of Chofu, Japan

[73] Assignee: Juki Corporation, Tokyo, Japan

[21] Appl. No.: 783,265

[22] Filed: Oct. 28, 1991

[30] Foreign Application Priority Data

Oct. 29, 1990 [JP] Japan ..... 2-288369

[51] Int. Cl.[5] ..... D05B 23/00; D05B 69/00; D05B 55/02

[52] U.S. Cl. ..... 112/171; 112/221; 112/226

[58] Field of Search ..... 112/170, 171, 221, 226

[56] References Cited

U.S. PATENT DOCUMENTS

| | | | |
|---|---|---|---|
| 2,402,251 | 6/1946 | Johnson | 112/171 |
| 3,351,102 | 11/1967 | Logan et al. | 112/171 X |
| 4,021,896 | 5/1977 | Stierlein | 112/171 X |
| 4,236,470 | 12/1980 | Stenson | 112/171 X |
| 4,248,165 | 2/1981 | Addy et al. | 112/171 X |

*Primary Examiner*—Clifford D. Crowder
*Assistant Examiner*—Paul C. Lewis
*Attorney, Agent, or Firm*—Morgan & Finnegan

[57] ABSTRACT

A sewing machine needle receiving and transferring arrangement wherein a clamp device for the needle is provided in each of the needle bars so as to engage or disengage the needle with or from each of the needle bars. Such clamp device engages or disengages depending on the energized or deenergized mode of a solenoid.

6 Claims, 4 Drawing Sheets (PRIOR ART)

NEEDLE RECEIVING AND TRANSFERRING APPARATUS FOR SEWING MACHINE

BACKGROUND OF THE INVENTION

This invention relates to a needle receiving and transferring apparatus for a sewing machine and more particularly to a device which is capable of alternately using a single needle as both, upper and lower needles.

Conventionally, a hand stitch machine has been constructed so that a pair of needle bars 1 are mounted opposite to each other with a needle plate (not shown) therebetween, as shown in FIG. 4. A needle 2 with pointed extremities at the opposite ends thereof, as shown in FIG. 5, is transferred from the upper needle bar 1 to the lower needle bar 1 and vice versa in response to up and down movement of the needle bars 1.

The needle 2 is provided with a needle eye 3 at the center thereof and arcuated recesses 4 on the opposite sides thereof adjacent to its upper and lower pointed extremities. The needle 2 is held stationary by urging or pressing balls 5 against the recesses 4, as shown in FIG. 6.

Each of the balls 5 is held in a race or groove 1*a* formed on the inner periphery of the needle bar 1 and also held in an opening 6*a* in a ball holder 6 inserted in a cylinder 7. When the bottom portion 8 of the needle bar 1, beneath the race or groove 1*a*, is in contact with the balls 5, the balls are urged toward the central axis of the needle bar 1 and fitted in the recesses 4, thereby clamping the balls therein.

The needle 2 is downwardly moved by a needle bar elevating mechanism (not shown) from a position where its upper pointed extremity is held in the upper needle bar 1, as shown in FIG. 6, to a position where it assumes its bottom dead center. At this time, a collar 9, fixed to the cylinder 7, impinges against the top of a needle bar bearing 10, secured to the machine frame to prevent it from moving downwardly. The needle bar 1, however, is further lowered against a spring 30 by the needle bar elevating mechanism. At the beginning of downward movement of the needle bar 1, the needle bar 1 is followed by the ball holder 6 to lower the latter under the influence of a spring 31. Then, the ball holder 6 stops in a position where the balls 5 abut against the lower ends of slots 7*a* in the housing 7. Thereafter, solely the needle bar 1 is further lowered. As a result, the bottom portion 8 of the needle bar 1 is moved downwardly away from the balls 5 to release the force by which the balls 5 were urged against the recesses 4 in the needle 2.

In this condition, the needle 2 is allowed to insert its lower pointed extremity into the lower needle bar 1 which engages and holds the balls 5 in the recesses 4 in the needle 2, completing a receiving and transferring operation of the needle 2.

With the same arrangement as aforementioned, when the lower needle bar 1 assumes its top dead center position, the balls 5 are disengaged from the recesses 4 in the needle 2, thus releasing the lower pointed extremity of the needle 2. At the same time, the upper pointed extremity of the needle 2 is held in the upper needle bar 1. In this manner, the needle 2 is received and transferred to continue a sewing operation as performed by a sewing machine.

FIGS. 7A–7F show successive steps of the sewing operation. More specifically, FIG. 7A is a representation of the manner in which an upper looper 12 is inserted into a loop of a thread 11. FIG. 7B is a view of the manner in which the thread 29 loop is retained or entangled by the upper looper 12. FIGS. 7C–7E are representations of the manner in which the needle 2 is lowered for the sewing operation. FIG. 7F is a view of the manner in which the thread loop is retained or entangled by a lower looper 13.

Such a conventional needle receiving and transferring apparatus for a hand stitch machine is disadvantageous in that high impact noises are repeatedly produced whenever the needle 2 is transferred between the upper and lower needle bars 1, since this is accompanied by collision of the collar 9 with the bearing 10. A further disadvantage is that the springs 30, 31 mounted in the needle bar 1 are required to become repeatedly compressed because of the repetitious relative motion of the ball holder 6 and the housing 7 in the needle bar, thereby shortening the operating life of the apparatus.

Further, difficulty is involved in setting the pressure intensity of the springs 30 or 31. For instance, if the spring 30 is too soft, the impulsive force caused by the collision of the collar 9 with the bearing 10, makes the cylinder 7 deviate from a position where the needle is located when the needle is received and transferred.

In contrast, if the spring is too stiff, problems in mechanical strength arise. Namely, a spindle 32 secured to the cylinder 7 is readily broken since the needle bar as a whole is slender. On the other hand, if the other spring 31 is too soft, this would permit the ball holder 6 to creep into the spring against the bias of the spring when the needle is transferred. In such a case, the recesses 4 in the needle 2 would come out of alignment with the balls 5, and result in a failure in chucking.

SUMMARY OF THE INVENTION

It is therefore an object of the invention to avoid the above disadvantages of the prior art and to provide a needle receiving and transferring apparatus.

It is another object of the invention to provide a needle receiving and transferring apparatus, wherein a solenoid is energized or deenergized for the purpose of receiving and transferring the needle from one to the other needle bar.

A further object of the invention is to provide a needle receiving and transferring apparatus which is operated without the noise produced by the prior art.

Still another object of the invention is to provide a needle receiving and transferring apparatus that is simple in construction and that does not wear and damage parts such as the springs and the like. Thus, a device of considerable durability is ensured.

Yet another object of the invention is to provide a needle receiving and transferring apparatus that requires neither balls in the needle bar nor recesses in the needle and that ensures a proper needle receiving and transferring operation.

These difficulties are obviated by the present invention. A needle receiving and transferring apparatus according to the invention is characterized by upper and lower needle bars disposed opposite to each other with a needle plate therebetween, with the upper needle bar positioned above the needle plate and the lower needle bar positioned beneath the needle plate. A needle transferring mechanism is provided in connection with each needle bar and is adapted to engage or disengage the needle by the energization of a solenoid.

BRIEF DESCRIPTION OF THE DRAWINGS

The invention will be described in greater detail below by way of reference to the following drawings, wherein.

DETAILED DESCRIPTION OF THE DRAWINGS

Figure 1:
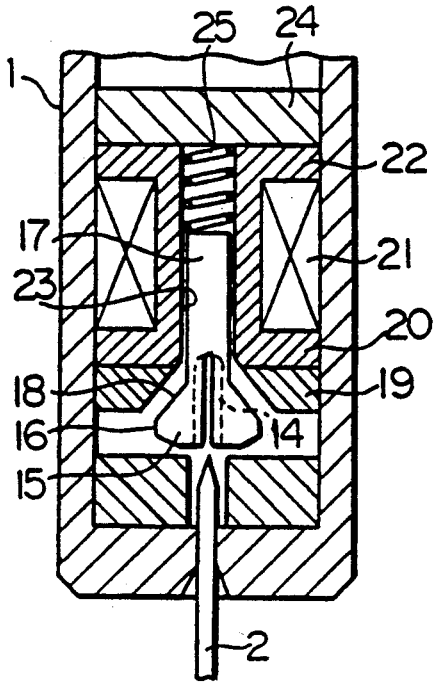
FIGS. 1-3 inclusive are fragmental sectional views showing the manner in which a needle receiving and transferring apparatus according to the present invention is actuated.

Referring to FIG. 1, there is shown a hollow needle bar 1 which includes a forked iron core collet 15 disposed therein. The collet 15 is partially split to form a slit. An opening 14 of the slit is provided at the center of the forked collet 15 for receiving therein the upper pointed extremity of a needle 2 inserted into the needle bar 1. The collet 15 is tapered from a large diameter end 16 toward a reduced strut 17 to provide a tapered surface 18. An annular support 19 in a ring form is arranged concentrically around the collet 15. The annular support 19 is secured to the needle bar 1 and is provided on its inner periphery with a complementary tapered surface to fit the tapered surface 18 of the collet 15. A solenoid 22 which consists of a yoke 20 and a coil 21 is located in the needle bar 1 and is formed with a central hole 23 to removably receive the strut 17. A return spring 25 is interposed between the end face of the strut 17 and a stopper 24 rigidly mounted on the inner wall of the needle bar 1.

Such upper and lower needle bars are identical to each other, hence it is deemed sufficient to describe only one needle bar.

Figure 2:
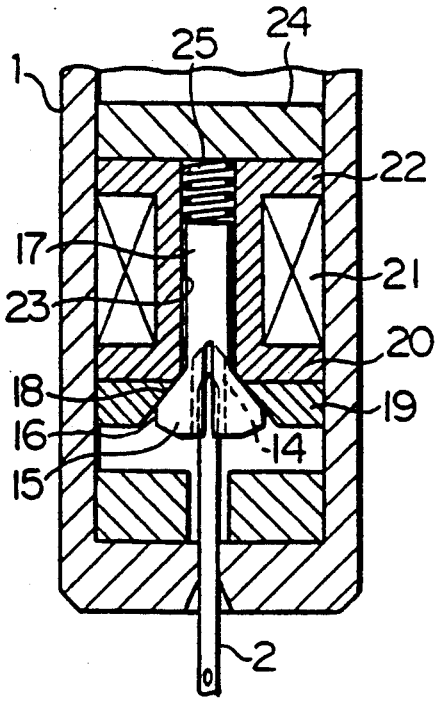
Figure 3:
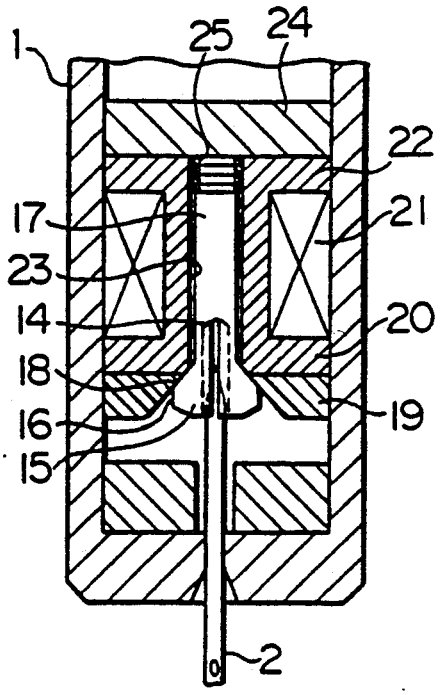
Figure 4:
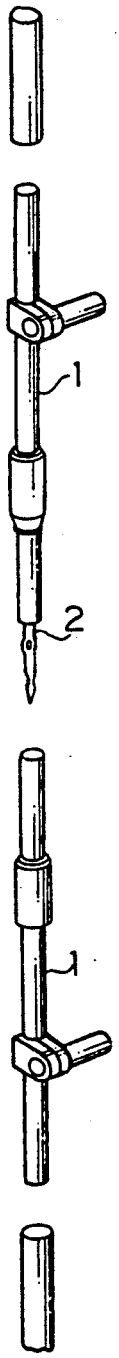
FIG. 4 is a representation explanatory of a conventional needle receiving and transferring apparatus.
Figure 5:
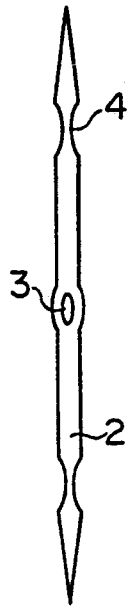
FIG. 5 is a view explanatory of a configuration of the needle used in the conventional needle receiving and transferring apparatus.
Figure 6:
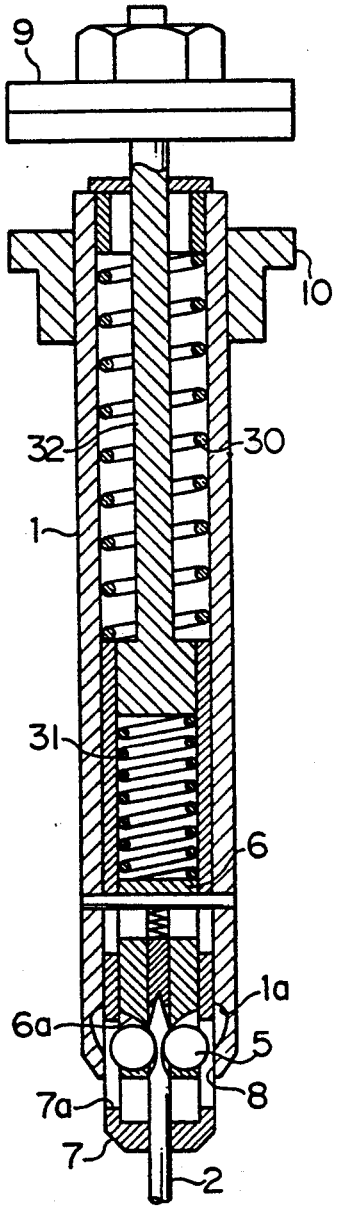
FIG. 6 is a view showing the details of a needle support mechanism used in the conventional needle receiving and transferring apparatus.
Figure 7A:
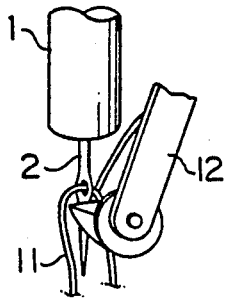
FIGS. 7A-7F are representations showing the sewing operation steps of a hand stitch machine.
Figure 7B:
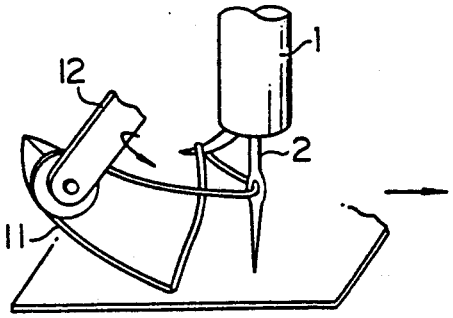
Figure 7C:
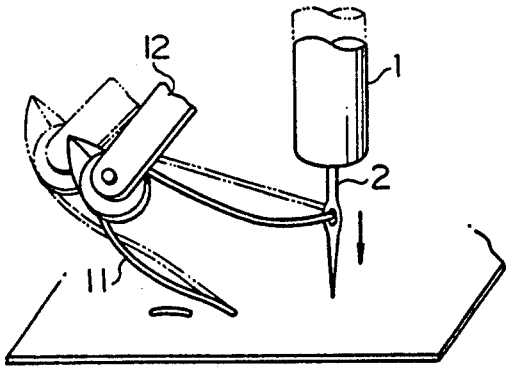
Figure 7D:
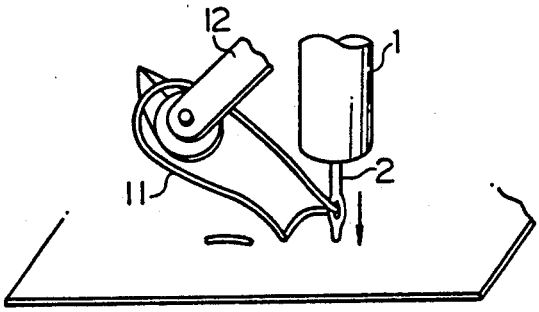
Figure 7E:
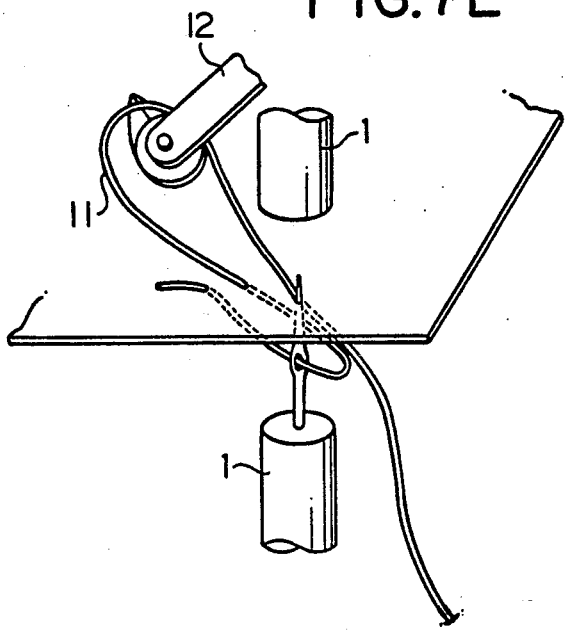
Figure 7F:
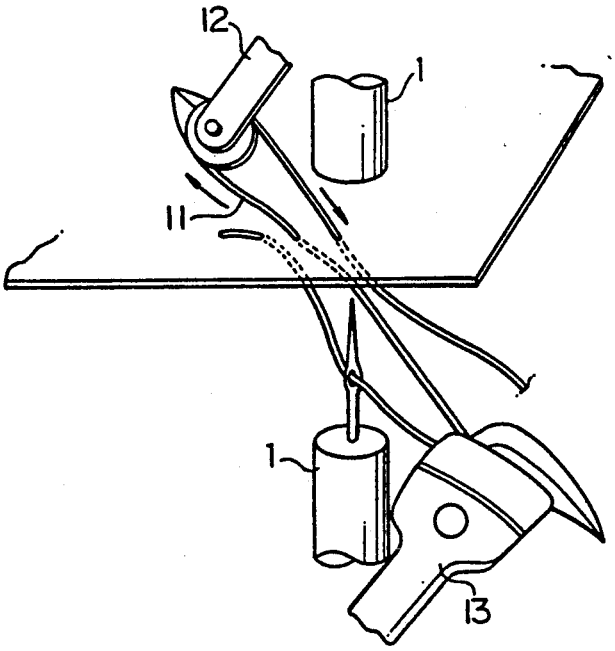

The needle receiving and transferring apparatus according to the invention is fabricated as aforementioned so that, as shown in FIG. 2, when the lower needle bar 1 is moved to its top dead center position, with the needle being clamped to it, the pointed extremity of the needle 2 is thereby inserted into the opening 14 of the slit in the collet 15 in the upper needle bar 1. This is sensed by a sensor (not shown) to excite the solenoid 22 of the upper needle bar 1. Consequently, the solenoid serves to draw the strut 17 of the collet 15 by electromagnetic force against the spring 25 through the center of the coil 21 of the solenoid 22, as seen from FIG. 3. In this instance, the tapered surface 18 of the collet 15 is pressed against the complementary surface of the annular support 19 to displace the split collet 15 in the direction of reducing the opening 14 of the slit. As a result, the pointed extremity of the needle 2 inserted into the opening 14 of the slit is firmly held thereby.

At this moment, the solenoid 22 for the lower needle bar 1 is deenergized to release the needle 2 from the corresponding collet 15 by action contrary to the aforementioned action so that the upper needle bar 1 is upwardly moved with the needle 2 being clamped and is then lowered with the needle 2 as clamped for the purpose of the sewing operation.

When the needle 2 in the upper needle bar 1 passes through the workpiece and assumes the bottom dead center position, thus inserting the lower pointed extremity of the needle 2 into the lower needle bar 1, the solenoid 22 for the upper needle bar 1 is deenergized and the solenoid 22 for the lower needle bar 1 is energized so that the needle transfer is accomplished in the same manner as aforementioned.

Although the invention has been described in detail herein by way of reference to the disclosed embodiment, it should be understood that the invention is not limited to the disclosed embodiment, but should be interpreted in accordance with the claims which follow.

We claim:

1. A sewing machine having a pair of needle bars disposed opposite to each other with a needle plate therebetween in the vertical axis and with opposed ends of the needle bars being cylindrical, a needle having pointed extremities at its opposite ends and a needle eye at its center for receiving a thread, and a needle receiving and transferring apparatus arranged in each of said opposed ends of said needle bars for reciprocating said needle, said needle receiving and transferring apparatus comprising:

an electromagnet disposed in each of said cylindrical opposed ends of said needle bars and said electromagnet having a coil in the form of a bobbin;

a clamp member formed of magnetic material having one end magnetically opposed to said coil in the form of a bobbin and an opposite end provided with a clamp portion for rendering said needle mountable and demountable, said clamp member being moved in said axial direction by way of electrical energization; and actuating means relatively mounted on said clamp portion and on each of said needle bars for actuation of said clamp portion in such a manner that said clamp portion engages said needle in association with movement of said clamp member in one direction of said axial direction, and that said clamp portion disengages said needle therefrom in association with movement of said clamp member in the reverse direction of said axial direction.

2. A sewing machine as claimed in claim 1 wherein said clamp portion is provided with an opening of a slit extending in the vertical axial direction to so form therein said opening that is capable of radially opening and closing in response to said actuating means, so as to receive and clamp one end of said needle.

3. A sewing machine as claimed in claim 1 wherein said actuating means is comprised of a first tapered surface formed on said clamp portion, said clamp portion having an opening, and a second tapered surface attached to said needle bar for opposing said first tapered surface, said second tapered surface being engaged with said first tapered surface by movement of said clamp member, thereby closing said opposing to allow clamping said needle.

4. A sewing machine comprising:

a pair of needle bars, having opposed ends, disposed opposite to each other with a needle plate therebetween in the vertical axis;

a needle having pointed extremities at its opposite ends and a needle eye at its center for receiving a thread; and a needle receiving and transferring device arranged in each of said opposed ends of said needle bars for reciprocating said needle; said needle receiving and transferring device including an electromagnet disposed within each of said opposed ends of said needle bars, a clamp device formed of magnetic material with a first end magnetically interacting with said electromagnet and an opposite end provided with a clamp portion for rendering said needle mountable and demountable, said clamp device being movably supported by each of said needle bars and said clamp device being moved by way of electrical energization of said electromagnet, and an actuating device disposed within said opposed ends of each of said needle bars in such a manner that said clamp portion clamps said needle in association with movement of said clamp device in one direction and that said clamp device disengages said needle therefrom in association with movement of said clamp device in the reverse direction.

5. A sewing machine as claimed in claim 4 wherein said clamp portion is provided with an opening of a slit extending in the vertical axial direction to so form therein said opening that is capable of radially opening and closing in response to said actuating device, so as to receive and clamp one end of said needle.

6. A sewing machine as claimed in claim 4 wherein said actuating device is comprised in claim 4 wherein said actuating device is comprised of a first tapered surface formed on said clamp portion, said clamp portion having an opening, and a second tapered surface attached to said needle bar to oppose said first tapered surface, said second tapered surface being engaged with said first tapered surface by movement of said clamp device, thereby closing said opening to allow clamping said needle.

* * * * *

UNITED STATES PATENT AND TRADEMARK OFFICE

CERTIFICATE OF CORRECTION

PATENT NO. : 5,193,473

DATED : March 16, 1993

INVENTOR(S) : Hideo Asao and Masato Takahashi

It is certified that error appears in the above-identified patent and that said Letters Patent is hereby corrected as shown below:

Column 2, line 2 - delete "29"

Column 4, line 60 - "opposing" should read --opening--

Column 6, lines 10-11 - delete "in claim 4 wherein said actuating device is comprised"

Signed and Sealed this

Twenty-eighth Day of December, 1993

*Attest:*

Bruce Lehman

BRUCE LEHMAN

*Attesting Officer*

*Commissioner of Patents and Trademarks*